United States Patent [19]

Beduz et al.

[11] Patent Number: 4,747,448

[45] Date of Patent: May 31, 1988

[54] HEAT EXCHANGERS

[75] Inventors: Carlo Beduz; Ralph G. Scurlock, both of Southampton, England

[73] Assignee: The BOC Group, PLC, Windlesham, England

[21] Appl. No.: 861,668

[22] Filed: May 6, 1986

Related U.S. Application Data

[63] Continuation-in-part of Ser. No. 660,665, Oct. 15, 1984, abandoned.

[30] Foreign Application Priority Data

Nov. 1, 1983 [GB] United Kingdom ..... 8329185

[51] Int. Cl.[4] ..... F28F 13/00; F25B 39/02

[52] U.S. Cl. ..... 165/133; 165/911; 62/527

[58] Field of Search ..... 165/133, 911; 62/527

[56] References Cited

U.S. PATENT DOCUMENTS

| | | | |
|---|---|---|---|
| 3,299,949 | 1/1967 | Beurtheret | 165/133 |
| 3,598,180 | 8/1971 | Moore, Jr. | 165/133 |
| 3,971,435 | 7/1976 | Peck | 165/133 X |
| 4,284,133 | 8/1981 | Gianni et al. | 165/133 |
| 4,434,842 | 3/1984 | Gregory | 165/133 |
| 4,602,681 | 7/1986 | Daikoku et al. | 165/133 |

FOREIGN PATENT DOCUMENTS

| | | | |
|---|---|---|---|
| 37260 | 3/1977 | Japan | 165/133 |
| 142649 | 11/1979 | Japan | 165/133 |
| 35394 | 3/1983 | Japan | 165/133 |
| 120086 | 7/1983 | Japan | 165/133 |

OTHER PUBLICATIONS

IBM Technical Disclosure Bulletin, vol. 18, No. 2, 1975, "Natural LSI Process Step to Create Controllable Boiling Centers", Miersch.

*Primary Examiner*—Ira S. Lazarus
*Assistant Examiner*—Peggy Niels
*Attorney, Agent, or Firm*—Chris P. Konkol; Larry R. Cassett

[57] ABSTRACT

A heat exchanger has a plurality of main flow passages 2 for cooling fluid. Each main flow passage has associated with it at least one narrow channel 10 defined by a surface of the main flow passage and an auxiliary surface on a separator plate 8. Relatively hot fluid flows over the separator plate 8 and heats the auxiliary surface such that bubbles formed in the channel are flattened by the surface opposite to the auxiliary surface and pressed against the auxiliary surface. The bubbles eventually pass through holes 12 in the channel 10 into the main flow passage 2 to rejoin the evaporating liquid pool.

3 Claims, 1 Drawing Sheet

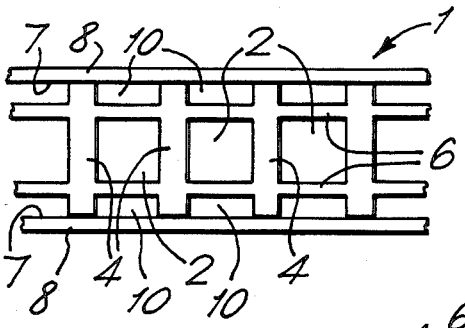
FIG.1.
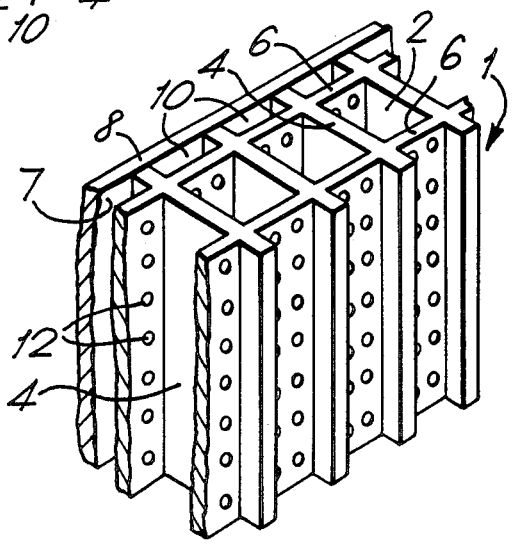
FIG.2.
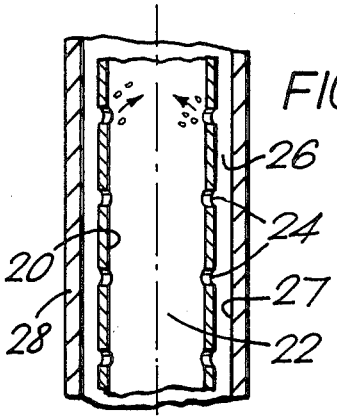
FIG.3.
FIG.4.
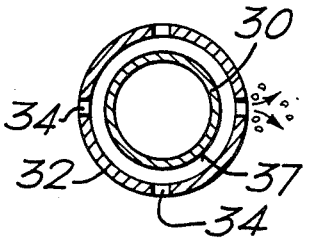

HEAT EXCHANGERS

This is a continutaiton-in-part of co-pending application Ser. No. 660,665 filed on Oct. 15, 1984, now abandoned.

BACKGROUND OF THE INVENTION

The present invention relates to heat exchangers and in particular heat exchangers suitable for boiling a liquefied gas such as liquid oxygen in a reboiler/condenser of an air separation plant.

An effective way of transferring heat from the heated surface of a heat exchanger to a fluid in contact with the surface is through the mechanism of nucleate boiling. It has been found that if the heated surface is roughened the irregularities or cavities so formed, become nucleation sites for the formation of bubbles.

It is known to arrange for such bubbles to be pressed against the heated surface by means of a physical barrier which with the heated surface defines a narrow channel. An enlarged bubble area in contact with the heated surface results in a large percentage of the heated surface being covered by a thin microlayer of liquid from which evaporation takes place advantageously directly into the bubbles. However, as the bubbles progress along the channel the liquid is drained from the slugs between adjacent bubbles which can lead to a "dry-out" situation in which vapour is in contact with the heated surface, that is, evaporation to dryness.

SUMMARY OF THE INVENTION

It is an aim of the present invention to provide a heat exchanger which is economic to manufacture and can offer all the aforesaid advantages of nucleate boiling but reduces the potential for the development of evaporation to dryness.

According to the present invention, a heat exchanger cmprises a core part having a hollow section defining a main flow passage for a fluid to be evaporated, the core part, in use, including a surface which together with an auxiliary surface spaced therefore, defines a narrow channel along which the fluid can also flow, at least one of said surfaces being heated, and the space being so dimensioned that, in use, bubbles generated on the heated surface are pressed and flattened by the other surface against the heated surface; and at least one opening from the channel into the main flow passage which permits the escape of bubbles from the heated surface and the replacement of evaporated fluid.

Preferably, a plurality of spaced, parallel main flow passages are formed from an extrusion of material of high thermal conductivity, each main flow passage having associated with it at least one channel and each channel having a plurality of through holes communicating with its associated main flow passage.

The auxiliary surface may be arranged on a side of a separator plate opposite the channels, the auxiliary surface being heated by the flow of a relatively hot fluid over the other side of the separator plate.

BRIEF DESCRIPTION OF DRAWINGS

Embodiments of the invention will now be described by way of example, reference being made to the Figures of the accompanying diagrammatic drawings in which :

FIG. 1 is a transverse cross-section through a heat exchanger according to the present invention;

FIG. 2 is a partial perspective view of one main flow passage of the heat exchanger of FIG. 1;

FIG. 3 is a longitudinal cross-section through a further heat exchanger of the present invention; and FIG. 4 is a transverse cross-section through yet a further heat exchanger of the present invention.

DETAILED DESCRIPTION OF THE INVENTION

Referring first to FIGS. 1 and 2, a heat exchanger 1 comprises a core part having a hollow section defining a plurality of main flow passages 2 for a cooling fluid. The main flow passages 2 are formed from an extrusion of material of high thermal conductivity such as aluminium. Each main flow passage 2 is defined by opposed side walls 4 and opposed upper and lower (as shown in FIG. 1) walls 6. The side walls 4 extend above and below respective upper and lower walls 6 and together with a auxiliary surface 7 on a separator plate 8 define channels 10. It is important that the aspect ratio of the channels 10, that is, in cross-section the width to height ratio is at least 10 to 1 to enable the microlayer factor to be effective. Each channel 10 is associated with a main flow passage 2 and a plurality of openings in the form of through holes 12 are formed in the walls 6 to permit flow of fluid between each channel 10 and its associated main flow passage 2. The space between the auxiliary surface 7 on the separator plate 8 and the opposite surface on the walls 6 is in the region of up to 3000 $\mu$m whilst the distance between immediately adjacent auxiliary surfaces 7 is in the order of 6 to 10 mm. The surfaces defining the channels can be surface treated, i.e. etched or plasma sprayed or knurled to provide nucleation sites. The edges of the side walls 4 can be in good thermal contact with the surfaces 7 of the separator plates 8 to enable walls 6 to act as heated surfaces in addition to the auxiliary surfaces 7.

In use, fluid such as liquid oxygen flows through the main flow passages 2 and the channels 10 whilst a relatively hot fluid flows over the separator plates 8. The auxiliary surfaces 7 will become hot and bubbles will form at nucleation sites. the bubbles will be flattened and pressed in the channels 10 by the upper and lower surfaces of the upper and lower walls 6 against the respective hotter auxiliary surfaces. As the bubbles progress along the channels, they will escape through the holes 12 between the channels 10 and the main flow passages 2 to join the main body of liquid oxygen.

In the above described embodiment, vapour or gas bubbles may be produced homogeneously or locally in the narrow channels 10. Vapour bubbles may be produced naturally by active nucleation sites on the heated auxiliary surface which can be treated in order to promote nucleation at low values of superheat.

Gas bubbles of the same composition or of a different compositon can also be introduced artificially in some of the narrow channels 10 through appropriate conduits. Vapour bubbles may also be produced by local heaters with large enough local dissipation to produce nucleate or film boiling.

Throughout this specification, the term "narrow channel" is to be interpreted to mean a channel small enough to squeeze the bubbles so that during most of the bubble residence time in the narrow channel it will produce an enlarged area of contact via a liquid microlayer with the surface from which heat is to be removed. It has been found that for optimum results the space between the surfaces should be between about 50 and 3000 μm.

As shown in FIGS. 3 and 4, the core of the heat exchanger may be in the form of two concentric cylinders. In FIG. 3 the inside cylinder 20 forms the main flow passage 22 or liquid pool and is provided with openings 24 to enable bubbles to escape from the narrow channel 26 which the outside surface of the inner cylinder forms with the inside or auxiliary surface 27 of an outer cylinder 28.

In FIG. 4, again two cylinders are coaxially arranged but in this instance the auxiliary surface 37 is the outside surface of the inner cylinder 30 whilst the outer cylinder 32 on its outside surface forms part of the main flow passage or liquid pool. The outer cylinder 32 has through holes 34 which enable bubbles to escape from the heated auxiliary outer surface of the inner cylinder into the main liquid pool.

In all the above described embodiments, the provision of openings through which the bubbles can pass to join the main liquid pool inhibits the chances of an "evaporation to dryness" situation.

Although reference has been made to the main flow passages 2 being formed from an extrusion other methods of forming could be used.

What is claimed is:

1. A heat exchanger comprising a core part having a hollow section defining a main flow passage for a fluid to be evaporated, the core part including a surface which together with an auxiliary surface spaced between about 50 and 3000 μm therefrom, defines a narrow channel coextensive in width with said main flow passage, at least one of said surfaces being heated and the cross-section of said narrow channel having a width to height ration of at least 10 to 1 so that, bubbles are generated from a microlayer of liquid on the heated surface and are pressed and flattened by the other surface against the heated surface; and said non-heated surface having at least one opening from the channel into the main flow passage which permits the escape of bubbles from the channel into the main flow passage to join the fluid flowing therein.

2. A heat exchanger as claimed im claim 1, in which a plurality of spaced, parallel main flow passages are formed from an extrusion of material of high thermal conductivity, each man flow passage having associated with it at least one of said channels and each said channel having a plurality of through holes communicating with its associated main flow passage.

3. A heat exchanger as claimed in claim 2, in which the auxiliary surface is arranged on a side of separator plate opposite the channels, the auxiliary surface being heated by the flow of a relatively hot fluid over the other side of the separator plate.

* * * * *